US005092809A

United States Patent [19]

Kessler

[11] Patent Number: 5,092,809

[45] Date of Patent: Mar. 3, 1992

[54] PINWHEEL TOY

[75] Inventor: Brian D. Kessler, Youngstown, Ohio

[73] Assignee: Maui Toys, Inc., Youngstown, Ohio

[21] Appl. No.: 628,550

[22] Filed: Dec. 15, 1990

[51] Int. Cl.[5] ..... A63H 33/40

[52] U.S. Cl. ..... 446/217; 446/219

[58] Field of Search ..... 446/47, 48, 217, 218, 446/219

[56] References Cited

U.S. PATENT DOCUMENTS

| | | | |
|---|---|---|---|
| 1,639,943 | 8/1927 | Heberling . | |
| 1,910,923 | 5/1933 | Kerr | 446/218 |
| 2,275,290 | 3/1942 | Dreyer . | |
| 2,510,336 | 6/1950 | Donahue . | |
| 2,857,507 | 10/1958 | Stel | 446/217 X |
| 2,923,088 | 2/1960 | Peretti | 446/217 |
| 3,475,850 | 11/1969 | Lee . | |
| 3,484,070 | 12/1969 | Horodko et al. . | |
| 3,711,360 | 1/1973 | Kent . | |
| 3,905,681 | 9/1975 | Nagel | 446/217 X |
| 3,974,369 | 8/1976 | Chmela et al. | 446/217 X |
| 4,055,840 | 10/1977 | Uchytil . | |
| 4,207,702 | 6/1980 | Boatman et al. | 446/219 X |
| 4,254,575 | 3/1981 | Gould | 446/219 X |
| 4,369,215 | 1/1983 | Offen et al. . | |
| 4,488,372 | 12/1984 | Lowen . | |
| 4,582,497 | 4/1986 | Lyons . | |
| 4,655,721 | 4/1987 | Loomis et al. . | |
| 4,678,450 | 7/1987 | Scolari et al. . | |
| 4,748,366 | 5/1988 | Taylor | 446/47 X |
| 4,765,724 | 8/1988 | Huichun . | |
| 4,767,373 | 8/1988 | Antonio | 446/217 |
| 4,886,687 | 12/1989 | Malott . | |

FOREIGN PATENT DOCUMENTS

| | | |
|---|---|---|
| 2536222 | 3/1977 | Fed. Rep. of Germany . |
| 2949901 | 6/1981 | Fed. Rep. of Germany . |
| 3511796 | 10/1986 | Fed. Rep. of Germany . |
| 3633570 | 4/1988 | Fed. Rep. of Germany . |

OTHER PUBLICATIONS

Kirk-Othmer Encyclopedia of Chemical Technology, vol. 6, Colorants for Plastics, p. 612.

Kirk-Othmer Encyclopedia of Chemical Technology, vol. 14, Luminescent Materials . . . , pp. 546-547/5-64-565.

*Primary Examiner*—Robert A. Hafer
*Assistant Examiner*—Sam Rimell
*Attorney, Agent, or Firm*—Browdy & Neimark

[57] ABSTRACT

A pinwheel toy has blades formed of transparent plastic, preferably polycarbonate, in which the transparent plastic contains fluorescent dye such that when the plastic is cut to form the blades, the cut edges are iridescent providing a pleasing and existing visual display either when the pinwheel is spinning or still.

3 Claims, 1 Drawing Sheet

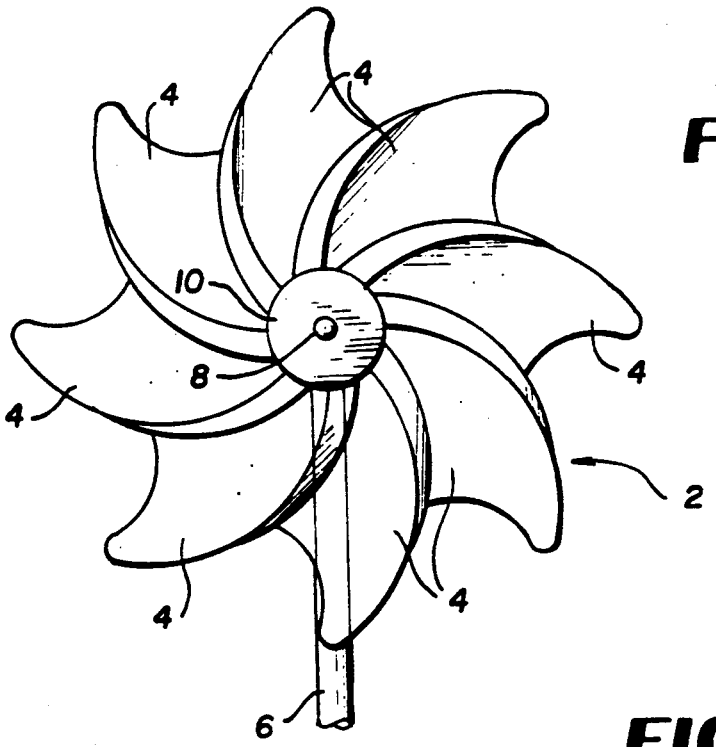
FIG. 1
FIG. 2
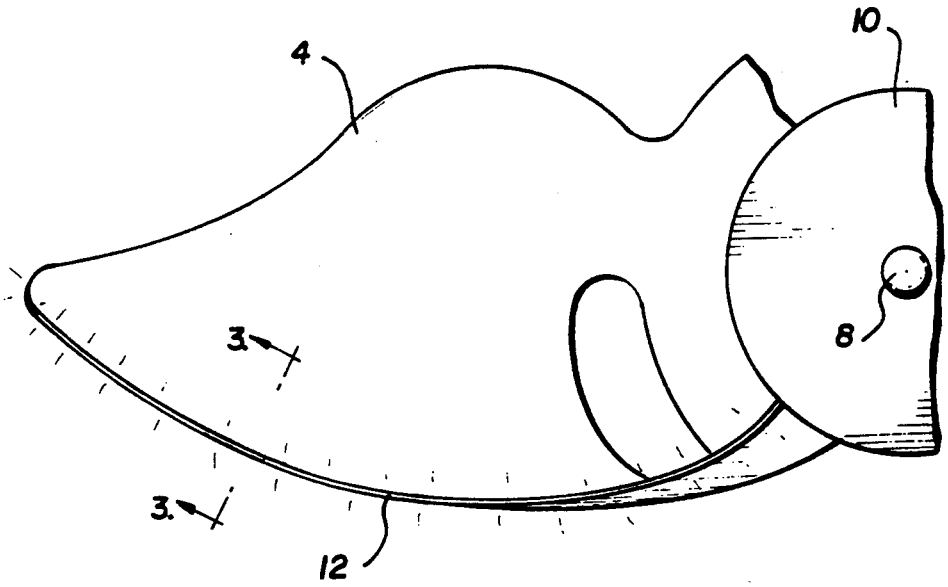
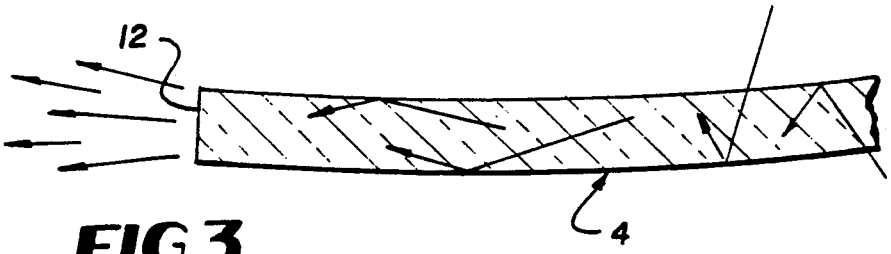
FIG. 3

PINWHEEL TOY

FIELD OF THE INVENTION

The invention relates to pinwheel toys and more particularly to a pinwheel toy presenting an unusual visual display, namely an iridescent or "glowing" effect at cut edges of the pinwheel blade material.

BACKGROUND OF THE INVENTION

Pinwheel toys are well known in the prior art. They usually consist of one or more shaped pieces of plastic, paper or the like, cut from sheet material to define a plurality of blades with a central orifice through which a pin or shaft is passed when the pinwheel is mounted. The pin or shaft is usually perpendicularly mounted to another elongated shaft which is used as a handle. Wind blowing against the blades of the pinwheel causes rotation of the blades about the pin or shaft like a propeller.

Attempts are often made by pinwheel makers to create impressive visual displays with the rotation of the pinwheel. For example, U.S. Pat. No. 2,857,507 discloses an electric lawn ornament having multicolored lights behind a pinwheel type and wheel producing an impressive visual display while spinning. Some pinwheels are also made to be visually impressive while not rotating such as by having various patterns imprinted on the blades.

Plastic toys of various types containing dyes or pigments, even fluorescent, phosphorescent and dayglow dyes or pigments, are also known. Regarding the general use of fluorescent pigments in plastics, the Kirk-Othmer Encyclopedia of Chemical Technology (3rd Ed., Vol. 6, page 612) states:

> Fluorescent pigments or dyes depend upon their ability to absorb light at one wavelength and to remit it in a narrow intense band at a longer wavelength . . . The dyes used include the rhodamines, which emit pink, and aminonaphthalimides which are bright greenish yellow. To obtain maximum effect, the dyes are dissolved in brittle resins at low concentrations. The colored resins are then ground to powders and used as pigments. The brightness of such a combination far exceeds that of any pigment alone.
>
> Fluorescent dyes do not have lightfastness. Their use in plastics is confined to the lower temperature resins, vinyls, polyethylene, and acrylics, at maximum temperatures of 200° C.

And from Volume 14, pp. 546-547:

> There are many types of luminescent materials, some of which require a special source of excitation such as an electric discharge or ultraviolet radiation. Daylight-fluorescent pigments, in contrast, require no artificially general energy. Daylight, or an equivalent white light, can excite these unique materials not only to reflect colored light selectively, but to give off an extra glow of fluorescent light, often with high efficiency and surprising brilliance . . .
>
> Daylight-fluorescent pigments, with a few exceptions, consist of particles of colorless resins containing dyestuffs that not only have color but are capable of intense fluorescence in solution. The resin is truly a solvent for the dyes. For example, in one resin system, a thermoplastic molten resin is formed containing the dye. Upon cooling to room temperature, the resin mass becomes very brittle. It is then pulverized to the proper fineness . . .
>
> A fluorescent substance is one that absorbs radiant energy of certain wavelengths and, after a fleeting instant, gives off part of the absorbed energy as quanta of longer wavelengths. In contrast to ordinary colors in which the absorbed energy degrades entirely to heat, light emitted from a fluorescent color adds to the light returned by simple reflection to give the extra glow characteristic of a daylight-fluorescent material. . .

Important Dyestuffs for Daylight-Fluorescent Pigments

| Name | CAS Registry Number | Colour Index (CI) Number | Manufacturer |
|---|---|---|---|
| Rhodamine B | [81-88-9] | Basic Violet 10 | BASF |
| Rhodamine F5G | [989-38-8] | Basic Red 1 | BASF |
| Xylene Red B | [3520-42-1] | Acid Red 52 | Sandoz Chemical |
| Fluorescent Yellow Y | [2478-20-8] | Solvent Yellow 44 | L. B. Holliday |
| Maxillon Brilliant Flavine 10GFF | [12221-8-2] | Basic Yellow 40 | CIBA-GEIGY |
| Alberta Yellow[a] | | Solvent Yellow 135 | Day-Glo Color |
| Potomac Yellow | [61902-43-0] | Solvent Yellow 160:1 | Day-Glo Color |
| Macrolex Fluorescent Yellow 10GN | | Solvent Yellow 160:1 | F. Bayer |

[a]Soluble only in strong solvents such as dimethyl formamide and in some molten resins.

And from Vol. 14, pp. 564,565:

> The brilliance of daylight-fluorescent colors leads to their use for the decoration and enhancement of a wide range of products. Children's plastic toys, plastic containers, and many other consumer items are colored with fluorescent pigments to heighten their appeal . . .
>
> Most manufacturers of fluorescent pigments offer special products for coloring thermoplastic molding resins . . . Low- and high-density polyethylene, high-impact and general purpose polystyrene, ABS, and various acrylic polymers are best suited for these pigments. The pigment, 1-2% of the total weight of the plastic, is added either as a dry-blended material or first formulated into a color-concentration pellet which is blended into the uncolored resin before molding into a finished article.

| Approximately Equivalent Commercial Pigment Colors[a] | | | | | |
|---|---|---|---|---|---|
| Day-Glo A-Series[b] | | Lawter B-3500 Series[c] | | Radiant R-105 Series[d] | |
| A-17-N | saturn yellow | B-3539 | lemon yellow | R-105-810 | chartreuse |
| A-18-N | signal green | B-3545 | green | R-1-5-811 | green |
| A-16-N | arc yellow | B-3515 | gold-yellow | R-105-812 | orange-yellow |
| A-15-N | blaze orange | B-3514 | yellow-orange | R-105-813 | orange |
| A-14-N | fire orange | B-3513 | red-orange | R-105-814 | orange-red |
| A-13-N | rocket red | B-3534 | red | R-105-815 | red |
| A-12 | neon red | B-3530 | cerise red | R-105-816 | cerise |
| A-11 | aurora pink | B-3522 | pink | R-105-817 | pink |
| A-21 | corona magenta | B-3554 | magenta | R-103-G-118 | magenta |
| A-19 | horizon blue | B-3556 | vivid blue | R-103-G-119 | blue |

[a]Similar colors are listed horizontally but are not exact color matches.
[b]Thermoplastic pigments for use in paint, screen ink, plastisol, gravure ink, paper coatings, and many other applications.
[c]Multipurpose pigments for paint, gravure ink, screen ink, paper coatings, plastisol, candles, plastics, and many other applications.
[d]Multipurpose pigments for paint, screen ink, paper coatings, plastisol, gravure ink, plastics, and many other applications.

In spite of such known prior art, pinwheels with glowing edges are not known.

SUMMARY OF THE INVENTION

It is an object of the present invention to provide a pinwheel having an exciting and novel visual display both when spinning and when not spinning.

It is another object of the present invention to provide a pinwheel having edges which are iridescent or "glowing" or have a "neon edge" appearance, thereby giving the appearance that the pinwheel is internally lighted.

The above objects are obtained in the present invention by providing one or more transparent plastic sheets containing one or more fluorescent, luminescent, phosphorescent or "dayglow" dyes or pigments, hereinafter sometimes generally referred to as "fluorescent dyes". When the plastic sheets are cut to create the pinwheel shape, the cut edges glow, i.e. they have a "glowing" or "neon edge" appearance or quality. While not wishing to be bound by this theory, it is believed that light is apparently absorbed through the flat surfaces of the plastic sheets, is amplified by the dye and allowed to escape through the cut edges, providing a glowing effect which is very pleasing to the eye.

BRIEF DESCRIPTION OF THE DRAWINGS

The above and other objects and the nature and advantages of the present invention will become apparent, and the present invention will be more clearly understood from the following detailed description taken in conjunction with the accompanying drawings, in which:

FIG. 1, is a front view of an embodiment of a pinwheel toy in accordance with the present invention;

FIG. 2, is a front view enlargement of one blade of the pinwheel toy of FIG. 1 in accordance with the present invention; and FIG. 3, is a cross-sectional view of the blade of the pinwheel toy shown in FIG. 2 taken along perspective view lines 3—3 of FIG. 2.

DETAILED DESCRIPTION OF THE PREFERRED EMBODIMENTS

Referring to FIG. 1, a pinwheel (2) according to the present invention is disclosed having blades (4), a handle (6) and pin or shaft (8). The pinwheel (2) also has an optional front facing piece (10) which is preferably made of the same material as the blades (4). The precise construction of the pinwheel (2) is not part of the present invention, and such pinwheel may take any operative form.

A novel feature of the pinwheel of the present invention is the use of a transparent plastic material containing an appropriate fluorescent dye or pigment for the blades (4) and optionally for the front facing piece (10), such fluorescent dye-containing material having the ability to glow at its cut edges in the presence of light as illustrated by cut edge (12) in FIG. 2. Cut edge (12) is shown in more detail in FIG. 3 which is taken along line 3—3 of FIG. 2. Light enters through the flat surfaces of the plastic blades (4) and is transmitted to the cut edge (12), producing a luminescent or iridescent or "neon edge" glowing effect very noticeable by and pleasing to the human eye. Furthermore, interesting patterns are created when the pinwheel (2) is spun by wind force.

An example of a pinwheel in accordance with the present invention was made starting with a sheet of transparent polycarbonate plastic (G.E.'s "Lexan") containing orange fluorescent dye. When the plastic was cut into the shape of a pinwheel blade blank, the cut edges where found to glow in a bright orange color in the presence of light.

It is to be understood that the pinwheel could be made of any suitable transparent plastic containing any fluorescent, phosphorescent or luminescent dye or pigment which produces the aforementioned effect, which is easily tested in a routine fashion. Polycarbonate resin is particularly suitable as the selected plastic, although PET and transparent styrene-butadiene copolymer of sufficient thickness and rigidity can also be used; plasticized vinyl resin is too soft. As examples of fluorescent dyes suitable for use with the styrene-butadiene copolymer there may be mentioned LQC-R412-1 (Trans Red), LQC-Y254-1 (Trans Yellow), LQC-G277 (Tans Green), Solvent Yellow 98 (xanthane dye), Solvent Green 5 (Perylene dye), Solvent Orange 63, Vat Red 41 and mixtures thereof. There may also be mentioned 3,9-perylene dicarboxylic acid diphenyl thioester which has been used in toys and is known to radiate a yellow-greenish color.

The foregoing description of the specific embodiments will so fully reveal the general nature of the invention that others can, by applying current knowledge, readily modify and/or adapt for various applications such specific embodiments without departing from the generic concept, and therefore such adaptations and modifications are intended to be comprehended within the meaning and range of equivalents of the disclosed embodiments. It is to be understood that the phraseology or terminology herein is for the purpose of description and not of limitation.

What is claimed is:

1. In a pinwheel toy of the type having a handle and blades adapted to spin about an axis in response to wind pressure, the improvement wherein said blades are formed of a sheet material having flat surfaces cut to define blade edges wherein said sheet material is comprised of a transparent plastic containing a luminescent dye which provides a brighter glowing effect to the cut blade edges than said flat surfaces.

2. The pinwheel toy of claim 1 wherein said transparent plastic is polycarbonate, polyethylene terephthalate or styrene-butadiene copolymer.

3. A method of making a pinwheel toy comprising the steps of:

providing a sheet of transparent plastic having flat surfaces and containing a luminescent dye which provides a glowing effect to cut edges of said sheet;

cutting said sheet into at least one pinwheel blade blank, the cut edges at said sheet providing a brighter glowing effect in the presence of light compared to said flat surfaces;

bending said pinwheel blank into a pinwheel blade shape; and mounting said pinwheel blade onto an axis about which said blade is able to rotate in response to wind pressure.

* * * * *